US010679471B2

(12) United States Patent
Laserson et al.

(10) Patent No.: US 10,679,471 B2
(45) Date of Patent: Jun. 9, 2020

(54) MODEL-BASED DATA VALIDATION

(71) Applicant: NCR Corporation, Duluth, GA (US)

(72) Inventors: Itamar David Laserson, Givat Shmuel (IL); Avishay Farbstein, Bruchin (IL); Tali Shpigel, Bnei brak (IL)

(73) Assignee: NCR Corporation, Atlanta, GA (US)

( * ) Notice: Subject to any disclaimer, the term of this patent is extended or adjusted under 35 U.S.C. 154(b) by 18 days.

(21) Appl. No.: 16/023,015

(22) Filed: Jun. 29, 2018

(65) Prior Publication Data

US 2020/0005603 A1 Jan. 2, 2020

(51) Int. Cl.

| | |
|---|---|
| ***G07G 1/00*** | (2006.01) |
| ***G07G 3/00*** | (2006.01) |
| ***A47F 9/04*** | (2006.01) |

(52) U.S. Cl.

CPC ..... *G07G 1/0072* (2013.01); *A47F 9/048* (2013.01); *G07G 3/003* (2013.01)

(58) Field of Classification Search

None

See application file for complete search history.

(56) References Cited

U.S. PATENT DOCUMENTS

| | | | | |
|---|---|---|---|---|
| 6,672,506 | B2 * | 1/2004 | Swartz | G06Q 30/06 235/383 |
| 9,053,473 | B2 * | 6/2015 | Edwards | G06Q 20/208 |
| 2017/0124587 | A1 * | 5/2017 | White | G06Q 30/0238 |

* cited by examiner

*Primary Examiner* — Kristy A Haupt

(74) *Attorney, Agent, or Firm* — Schwegman, Lundberg & Woessner

(57) ABSTRACT

Various embodiments herein each include at least one of systems, methods, and software for model-based data validation to identify when self-scan checkout data requires validation. Some embodiments, in the form of a method includes receiving, via a network from a self-scanning device, a self-scan dataset of items for purchase within a purchase data processing transaction and evaluating the self-scan dataset to determine whether to require a rescan of items represented in the self-scan dataset. In such embodiments when a rescan is determined to be required, the method includes transmitting via the network to at least one of the self-scan device and at least one device of a store employee data indicating a rescan is required. However, when a rescan is not determined to be required, the method includes permitting the purchase data processing transaction to proceed.

17 Claims, 4 Drawing Sheets

MODEL-BASED DATA VALIDATION

BACKGROUND INFORMATION

A recent survey conducted in the United Kingdom revealed that 33% of all customers regularly steal through the do-it-yourself checkout area. Retailers estimate that such transactions generate a shrinkage rate of 3.97%, more than 122% higher than the overall shrinkage rate. Yet, more and more retailers seek to save labor costs and improve their customer shopping experiences by adopting "do-it-yourself" checkout solutions.

The three most common do-it-yourself checkout solutions are:

a. Self-Checkout Terminals—machines that provide a mechanism for customers to process their own purchases from a retailer.

b. Handheld Self-Scan Devices—handheld devices that provide customers the ability to scan items while they shop. Checkout is usually done at a self-checkout terminal without having to scan the products again.

c. Mobile Shopping—offers similar experience as handheld devices, only that shoppers use their own mobile device to scan items.

A recent survey conducted in the United Kingdom revealed that 33% of all customers regularly steal through the do-it-yourself checkout area. Retailers estimate that such transactions generate a shrinkage rate of 3.97%, more than 122% higher than the overall shrinkage rate. Yet, more and more retailers seek to save labor costs and improve their customer shopping experiences by adopting "do-it-yourself" checkout solutions.

In attempt to reduce retail losses on "do-it-yourself" checkout touchpoints, retailers often apply a rescan solution where a certain percentage of the transactions are scanned again by a store employee to make sure no items were missed by the shopper. If the rescan finds an item that was missing in the original transaction, then the rescan reveals a possible fraud attempt or a customer scanning error. Regardless, both lead to shrinkage if not caught. Typically, retailers seek to run as many justified rescans that detect missed items as possible, while maintaining an overall low rescan rate to preserve good customer experiences.

SUMMARY

Various embodiments herein each include at least one of systems, methods, and software for model-based data validation to identify when self-scan checkout data requires validation. Some embodiments, in the form of a method includes receiving, via a network from a self-scanning device, a self-scan dataset of items for purchase within a purchase data processing transaction and evaluating the self-scan dataset to determine whether to require a rescan of items represented in the self-scan dataset. In such embodiments when a rescan is determined to be required, the method includes transmitting via the network to at least one of the self-scan device and at least one device of a store employee data indicating a rescan is required. However, when a rescan is not determined to be required, the method includes permitting the purchase data processing transaction to proceed. Some such embodiments further include generating and storing a fraud predictive model based on historic transaction data including data of at least some transactions known to include fraud and indicated as such within the historic transaction data.

Some other embodiments are in the form of systems that include at least one processor, a network interface device, and at least one memory device storing instructions executable by the at least one processor to perform data processing activities. The data processing activities may include receiving, via the network interface device from a self-scanning device, a self-scan dataset of items for purchase within a purchase data processing transaction and evaluating the self-scan dataset to determine whether to require a rescan of items represented in the self-scan dataset. When a rescan is determined to be required, the data processing activities include transmitting via the network interface device to at least one of the self-scan device and at least one device of a device of a store employee data indicating a rescan is required. However, when a rescan is not determined to be required, the data processing activities may instead permit the purchase data processing transaction to proceed.

DETAILED DESCRIPTION

Figure 1:
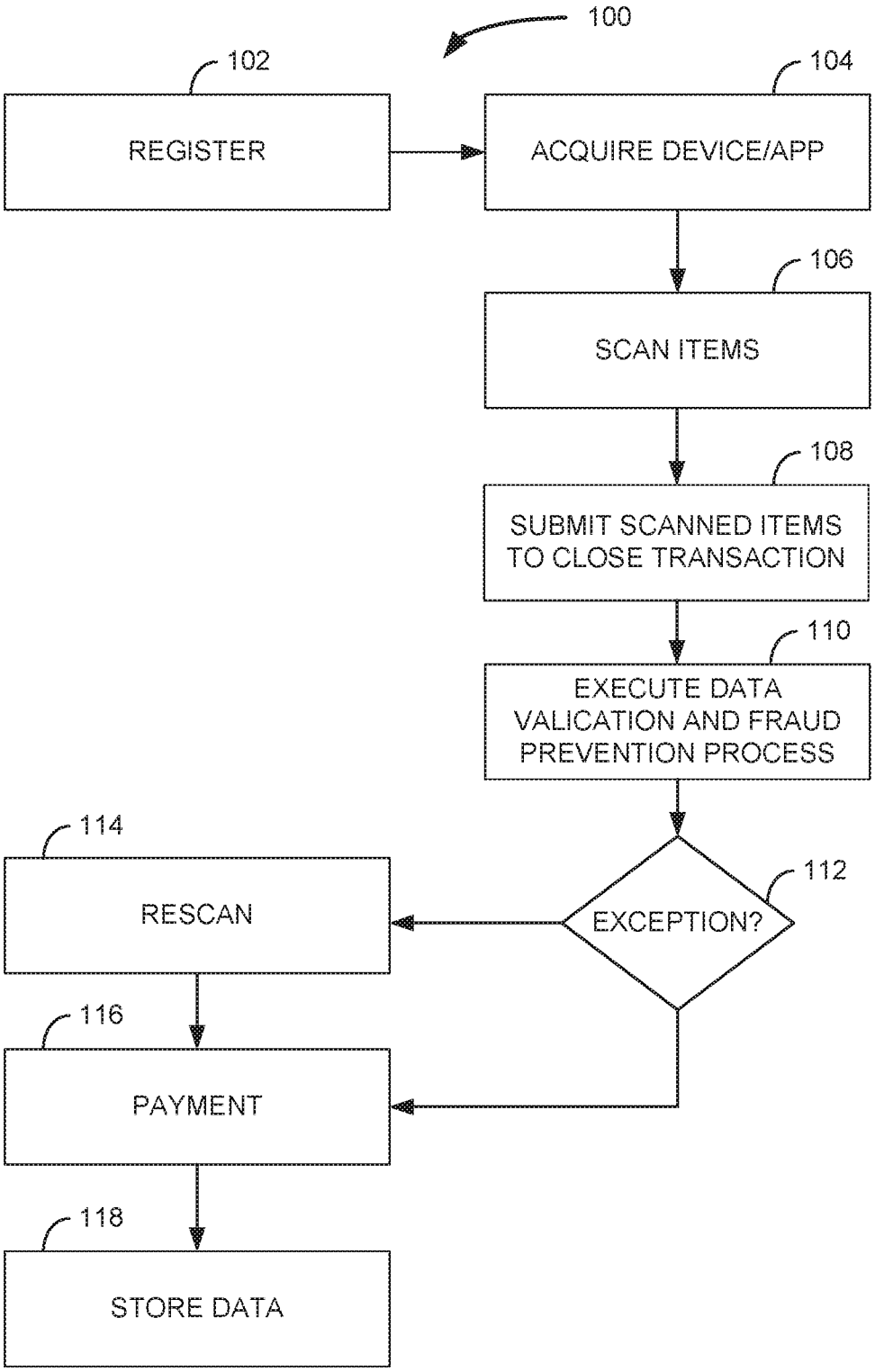
FIG. 1 is a block flow diagram of a method, according to an example embodiment.

Various embodiments herein each include at least one of systems, methods, and software for model-based data validation to identify, when self-scan checkout data requires validation. As mentioned above, more and more retailers seek to save labor costs and improve their customer shopping experiences by adopting "do-it-yourself" checkout solutions. However, these solutions have become a source of shrinkage from customer mistakes scanning and from fraud, offsetting gains from reduced labor costs.

In a typical embodiment, a customer scans their own items, whether that be with a store-provided device, a customer mobile device including a mobile app through which the scanning may be performed, or a self-service checkout (SSCO) terminal. Once a customer has scanned all of their items, the customer may provide an input to conclude the transaction. At this point, the scanned items may first be validated based on a model to determine (e.g., predict) a likelihood of the presence of an un-scanned or mis-scanned item requiring a rescanning of items in a customer cart or otherwise carried. Some embodiments may also take into account other factors or policies such as randomly or periodically requiring rescanning for customers specifically or generally, specifically rescanning a particular customer based on observed customer behavior, and other factors and policies. Such factors operate to make customers aware that there is a chance attempted fraud may be caught and that they are being monitored, but also that there are systems in place to help them ensure their transactions are conducted honestly and fairly for all parties.

The likelihood of a transaction including un-scanned or mis-scanned items generally includes generation and implementation of machine-learning generated and refined models. Such models are utilized for identification of customer transactions where a rescanning of cart contents is more likely to reveal an un-scanned or mis-scanned item that would otherwise lead to shrinkage. The models generated through machine learning, such as a neural network model or other model generation and implementation mode, may consider any number of factors such as individual self-scanned items, combinations of scanned items, location of a store where items are scanned or picked up for placement in the cart, a total number of scanned items, a value of one or more items, and intervals between scanning of items. Some embodiments, may also consider a number of items removed after scanning, average price of removed items, a price of any single item removed after scanning, combinations of items, and even information specific to a customer. Such customer-specific information may include a customer trust score or the lack thereof, a known or unknown identity of the customer, an age of a customer account (e.g., new accounts may be treated differently from older accounts), and other such factors that may be determined from data.

The generation of the model based on such data may include generation of an initial model based on historic transaction data including data of transactions known to include shrinkage activity whether from customer error or theft. The model may then be later updated or regenerated based on more recent transaction data.

Such models may be applied at a time of checkout prior to conclusion of a purchase transaction to determine a likelihood that the transaction includes un-scanned items. When there is no or low likelihood a transaction includes un- or mis-scanned items and there is not a policy or other factor requiring rescanning, the customer may then be invited to pay for the items and complete the transaction. However, if a rescan is required, store personnel may rescan the items, or visually validate or otherwise verify the veracity of the scan data, and the transaction may proceed.

One such embodiment was tested against an actual transaction dataset that without the solutions set forth herein had a rescan rate of fifteen percent and discovered un-scanned items in fifteen percent of the rescanned transactions. More specifically, 10,000 actual transactions were considered that resulted in 1,500 rescans and 225 of those rescans revealed un-scanned items. The tested embodiment according to the contributions herein instead only needed to identify 558 transactions for rescanning to reach the same number of transactions that included un-scanned items. The solution according to the contributions herein therefore reduced the rescan rate by 63% to achieve the same result. In this same test, rescanning accuracy increased from fifteen percent to 34.7 percent. These improvements are significant because rescanning items can frustrate customers, add time for some or all customers in concluding their store visits, and breed a negative customer sentiment from perceived mistrust of customers. Additionally, rescanning requires store personnel and equipment, thereby offsetting efficiency gains from self-checkout solutions.

These and other embodiments are described herein with reference to the figures.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims.

The functions or algorithms described herein are implemented in hardware, software or a combination of software and hardware in one embodiment. The software comprises computer executable instructions stored on computer readable media such as memory or other type of storage devices. Further, described functions may correspond to modules, which may be software, hardware, firmware, or any combination thereof. Multiple functions are performed in one or more modules as desired, and the embodiments described are merely examples. The software is executed on a digital signal processor, ASIC, microprocessor, or other type of processor operating on a system, such as a personal computer, server, a router, or other device capable of processing data including network interconnection devices.

Some embodiments implement the functions in two or more specific interconnected hardware modules or devices with related control and data signals communicated between and through the modules, or as portions of an application-specific integrated circuit. Thus, the exemplary process flow is applicable to software, firmware, and hardware implementations.

FIG. 1 is a block flow diagram of a method 100, according to an example embodiment. The method 100 is an example of a method that may be performed to implement a self-scan solution along with model-based data validation to identify when self-scan checkout data should be reacquired through rescanning, or at least employee visual validation.

The method 100, in some embodiments, includes a customer registering 102 to utilize a self-scanning solution. This may include setting up a customer account, such as may be used to login to a mobile device app, to associate transactions with a customer loyalty account, and the like. However, registering for a customer account or logging into a customer account is not required in all embodiments.

The method 100 further include acquiring 104 a store provided scanning device or mobile app on a customer mobile device through which items may be scanned. The acquiring 104 may also be initiating scanning at a SSCO terminal in some embodiments. The method 100 then includes the customer scanning 106 items for purchase with the acquired 104 device and when finished, submitting 108 the scanned items to close the transaction.

Submitting 108 the scanned items to close the transaction in such embodiments includes submitting some or all of the transaction data from the acquired 104 device over a network for processing. The processing includes executing 110 data validation and fraud prevention processing. The executing 110 of this processing may include securely submitting some or all of the transaction data and customer data, if available, to a network process, such as a webservice, for consideration. This may include considering of the transaction data and scanned items to determine a likelihood of an un- or mis-scanned item being present in the transaction in view of a model generated from historic transaction data. The considerations may also be specific with regard to a known customer history and trust level based thereon, and in some embodiments on other data specific to the known customer such as a customer reputation score. Store policies, rules, and configurations may also be included in such considerations, some of which may be random requirements for rescanning. The processing will return an indication of an exception indicating whether a rescan of items is required. In some embodiments, the exception indication does not differentiate between a likelihood of fraud and random rescans. In some other embodiments, differentiation may be made to better inform store personnel if so desired by a store operator.

When an exception is indicated, the method 100 at 112 routes the customer for re-scanning 114 and subsequently requests payment 116. When no exception is returned, the method 110 at 112 routes the processing to request payment 116. After payment 116 is received, the method 100 stores 118 transaction data, which may include an update to known customer transaction history and trust or reputation score when a trust or reputation score or other similar measure is utilized.

Figure 2:
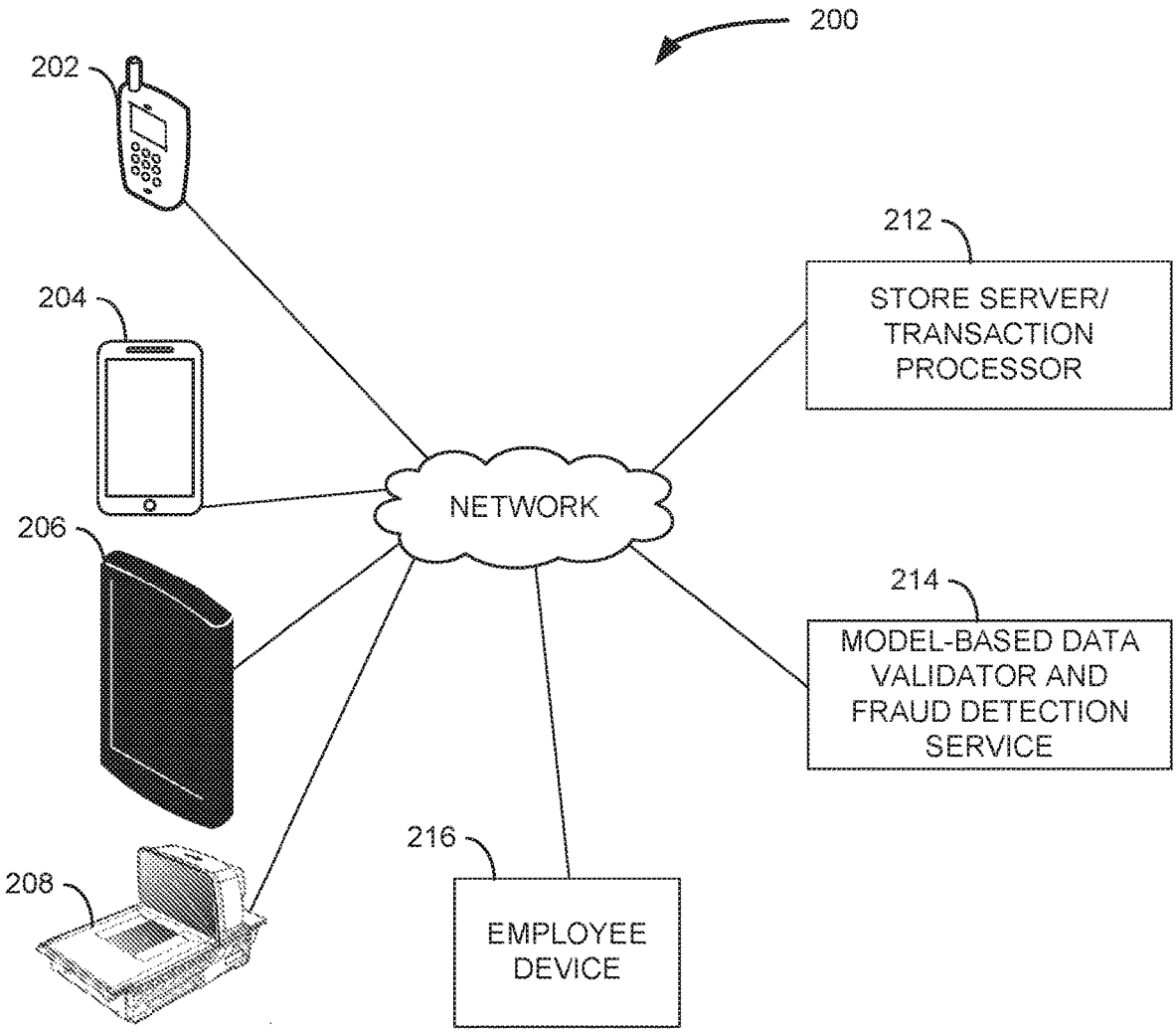
FIG. 2 is a logical block diagram illustrating a system architecture, according to an example embodiment.

FIG. 2 is a logical block diagram illustrating a system 200 architecture, according to an example embodiment. The system 200 is an example of a system upon which the method 100 may be implemented.

The system 200 includes scanning devices which may be handheld scanners 202, customer mobile devices 204 and tablets 206 that include an app thereon that is utilized to scan items within transactions, and SSCO terminals 208. Each of the scanners 202, customer mobile devices 204 and tablets 206, and SSCO terminals 208 are connected to a data network 210.

Also connected to the network 210 may be a store system and transaction processor 212. The store system and transaction processor 212 may be located at a store in whole or in part. The system 200 also includes a model-based data validator and fraud detection service 214. The model-based data validator and fraud detection service 214 may be implemented on the store system and transaction processor 212, as a service hosted by a third-party service provider as a cloud-accessible solution, or otherwise. The system 200 further includes one or more employee device 216 that may be employee specific or store specific to communicate to employees and allow employees to input data, such as when a rescan is required.

Figure 3:
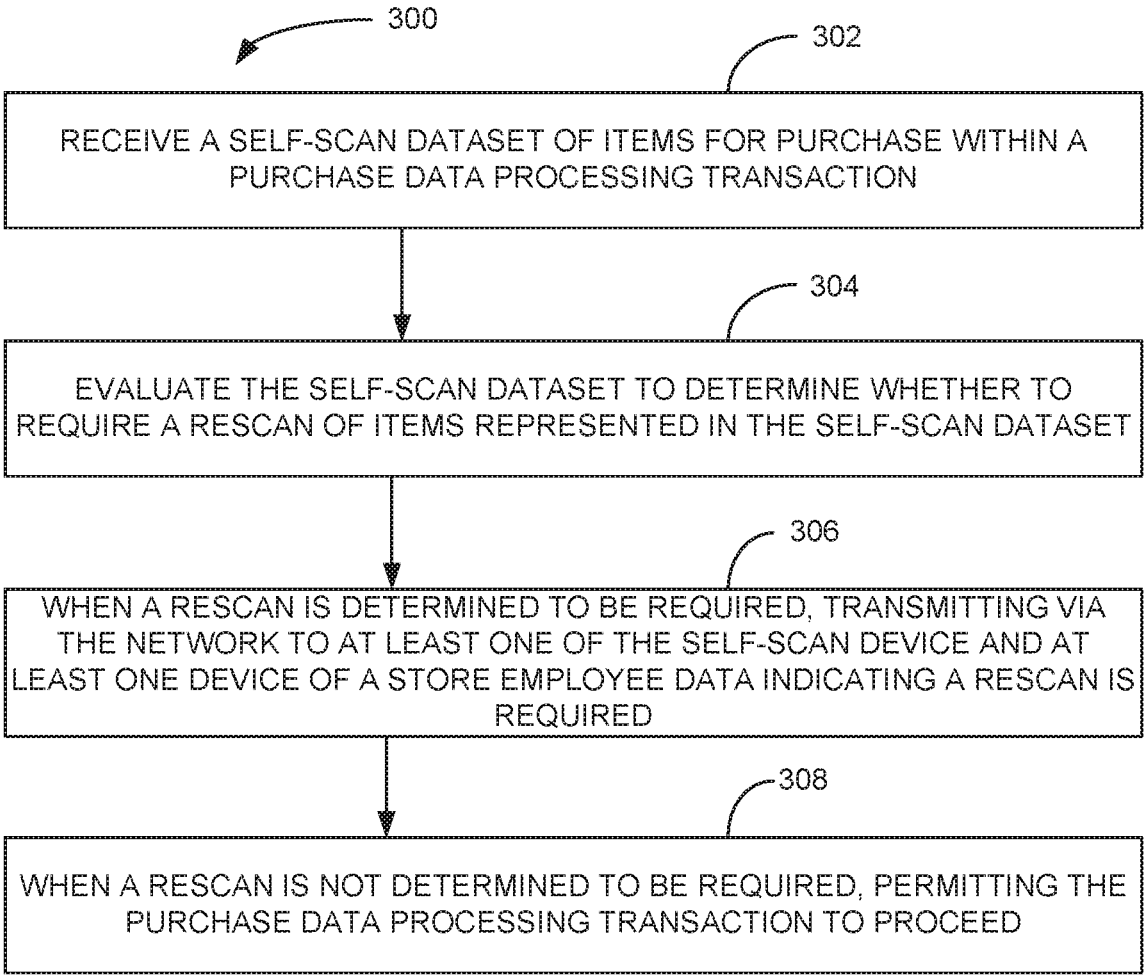
FIG. 3 is a block flow diagram of a method, according to an example embodiment.

FIG. 3 is a block flow diagram of a method 300, according to an example embodiment. The method 300 is an example of a method that may be performed by the model-based data validator and fraud detection service 214 of FIG. 2.

The method 300 includes receiving 302, via a network from a self-scanning device, a self-scan dataset of items for purchase within a purchase data processing transaction and evaluating 304 the self-scan dataset to determine whether to require a rescan of items represented in the self-scan dataset. When a rescan is determined to be required, the method 300 includes transmitting 306 via the network to at least one of the self-scan device and at least one device of a store employee data indicating a rescan is required. However, when a rescan is not determined to be required, the method 300 includes permitting 308 the purchase data processing transaction to proceed.

In some embodiments, evaluating 304 the self-scan dataset to determine whether to require a rescan of items represented in the self-scan dataset includes classifying the self-scan dataset based at least upon a transaction classification model. The transaction classification model in some embodiments is generated by a machine learning algorithm processing completed transaction data that included data of transactions with un-scanned items that were identified through rescanning. The completed transaction data processed by the machine learning algorithm may include data representative of scanning behaviors of items scanned and added to the self-scan dataset and subsequently removed prior to submission of the self-scan dataset within the purchase data processing transaction.

In some other embodiments, evaluating 304 the self-scan dataset to determine whether to require a rescan of items represented in the self-scan dataset further includes applying one or more configurable rules. The one or more configurable rules may include a transaction trigger that identifies a data condition with regard to one or more data items that trigger a rescan requirement when present within a self-scan dataset, such as an item that is frequently present in transactions involving fraud. The one or more configurable rules may also, or instead, include one or more of periodic and random rescan requirements with regard to all transactions, periodic and random rescan requirements with regard to a known customer, periodic and random rescan requirements with regard to an unknown customer, and a data input by an employee requiring a rescan, such as when suspicious customer behavior is observed. In some such embodiments, periodic and random rescan requirements of known customers are influenced by a determined trust level of respective customers that are influenced at least in part by a history of prior transactions including at least one item identified through rescanning.

In another embodiment of the method 300, the data indicating a rescan is required includes a transaction interrupt to prevent the purchase transaction from proceeding until input is received from an authorized store employee.

Further, the data indicating a rescan is required may include a command that prevents a customer from making a payment to complete the purchase data processing transaction. Also, permitting 308 the purchase data processing transaction to proceed includes transmitting data to the self-scanning device to instruct a user of the self-scanning device to make a payment.

Figure 4:
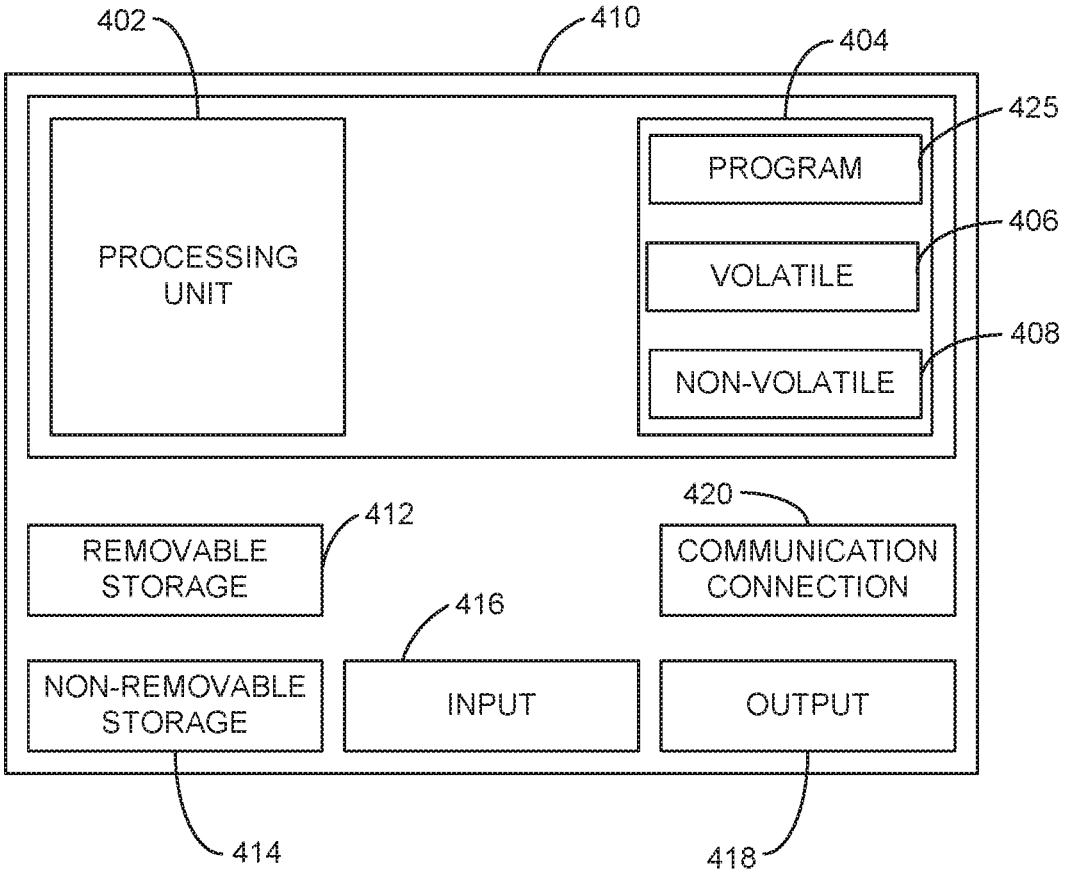
FIG. 4 is a block diagram of a computing device, according to an example embodiment.

FIG. 4 is a block diagram of a computing device, according to an example embodiment. In one embodiment, multiple such computer systems are utilized in a distributed network to implement multiple components in a transaction-based environment. An object-oriented, service-oriented, or other architecture may be used to implement such functions and communicate between the multiple systems and components. One example computing device in the form of a computer 410, may include a processing unit 402, memory 404, removable storage 412, and non-removable storage 414. Although the example computing device is illustrated and described as computer 410, the computing device may be in different forms in different embodiments. For example, the computing device may instead be a smartphone, a tablet, smartwatch, or other computing device including the same or similar elements as illustrated and described with regard to FIG. 4. Devices such as smartphones, tablets, and smartwatches are generally collectively referred to as mobile devices. Further, although the various data storage elements are illustrated as part of the computer 410, the storage may also or alternatively include cloud-based storage accessible via a network, such as the Internet.

Returning to the computer 410, memory 404 may include volatile memory 406 and non-volatile memory 408. Computer 410 may include—or have access to a computing environment that includes a variety of computer-readable media, such as volatile memory 406 and non-volatile memory 408, removable storage 412 and non-removable storage 414. Computer storage includes random access memory (RAM), read only memory (ROM), erasable programmable read-only memory (EPROM) and electrically erasable programmable read-only memory (EEPROM), flash memory or other memory technologies, compact disc read-only memory (CD ROM), Digital Versatile Disks (DVD) or other optical disk storage, magnetic cassettes, magnetic tape, magnetic disk storage or other magnetic storage devices, or any other medium capable of storing computer-readable instructions.

Computer 410 may include or have access to a computing environment that includes input 416, output 418, and a communication connection 420. The input 416 may include one or more of a touchscreen, touchpad, mouse, keyboard, camera, one or more device-specific buttons, one or more sensors integrated within or coupled via wired or wireless data connections to the computer 410, and other input devices. The computer 410 may operate in a networked environment using a communication connection 420 to connect to one or more remote computers, such as database servers, web servers, and other computing device. An example remote computer may include a personal computer (PC), server, router, network a peer device or other common network node, or the like. The communication connection 420 may be a network interface device such as one or both of an Ethernet card and a wireless card or circuit that may be connected to a network. The network may include one or more of a Local Area Network (LAN), a Wide Area Network (WAN), the Internet, and other networks. In some embodiments, the communication connection 420 may also or alternatively include a transceiver device, such as a BLUETOOTH® device that enables the computer 410 to wirelessly receive data from and transmit data to other BLUETOOTH® devices.

Computer-readable instructions stored on a computer-readable medium are executable by the processing unit 402 of the computer 410. A hard drive (magnetic disk or solid state), CD-ROM, and RAM are some examples of articles including a non-transitory computer-readable medium. For example, various computer programs 425 or apps, such as one or more applications and modules implementing one or more of the methods illustrated and described herein or an app or application that executes on a mobile device or is accessible via a web browser, may be stored on a non-transitory computer-readable medium.

It will be readily understood to those skilled in the art that various other changes in the details, material, and arrangements of the parts and method stages which have been described and illustrated in order to explain the nature of the inventive subject matter may be made without departing from the principles and scope of the inventive subject matter as expressed in the subjoined claims.

What is claimed is:

1. A method comprising:

receiving, via a network from a self-scanning device, a self-scan dataset of items for purchase within a purchase data processing transaction;

evaluating the self-scan dataset to determine whether to require a rescan of items represented in the self-scan dataset by classifying the self-scan dataset based at least upon a transaction classification model generated by a machine learning algorithm processing of completed transaction data that included data of transactions with un-scanned items that were identified through rescanning;

when a rescan is determined to be required, transmitting via the network to at least one of the self-scan device and at least one device of a store employee data indicating a rescan is required; and when a rescan is not determined to be required, permitting the purchase data processing transaction to proceed.

2. The method of claim 1, wherein the completed transaction data processed by the machine learning algorithm includes data representative of scanning behaviors of items scanned and added to the self-scan dataset and subsequently removed prior to submission of the self-scan dataset within the purchase data processing transaction.

3. The method of claim 1, wherein evaluating the self-scan dataset to determine whether to require a rescan of items represented in the self-scan dataset further includes applying one or more configurable rules.

4. The method of claim 3, wherein the one or more configurable rules include at least one of:

a transaction trigger that identifies a data condition with regard to one or more data items that trigger a rescan requirement when present within a self-scan dataset;

periodic and random rescan requirements with regard to all transactions;

periodic and random rescan requirements with regard to a known customer;

periodic and random rescan requirements with regard to an unknown customer; and a data input by an employee requiring a rescan.

5. The method of claim 4, wherein periodic and random rescan requirements of known customers are influenced by a determined trust level of respective customers that are influenced at least in part by a history of prior transactions including at least one item identified through rescanning.

6. The method of claim 1, wherein the data indicating a rescan is required includes a transaction interrupt to prevent the purchase transaction from proceeding until input is received from an authorized store employee.

7. The method of claim 1, wherein:

the data indicating a rescan is required includes a command that prevents a customer from making a payment to complete the purchase data processing transaction; and permitting the purchase data processing transaction to proceed includes transmitting data to the self-scanning device to instruct a user of the self-scanning device to make a payment.

8. The method of claim 1, wherein the self-scanning device is a customer mobile device.

9. A method comprising:

generating and storing a fraud predictive model based on historic transaction data including data of at least some transactions known to include fraud and indicated as such within the historic transaction data;

receiving, via a network from a self-scanning device, a self-scan dataset of items for purchase within a purchase transaction;

evaluating the self-scan dataset based on the fraud predictive model to determine whether to require a rescan of items represented in the self-scan dataset;

when a rescan is determined to be required, transmitting via the network to at least one of the self-scan device and at least one device of a store employee data indicating a rescan is required; and when a rescan is not determined to be required, permitting the purchase data processing transaction to proceed.

10. The method of claim 9, wherein:

the fraud predictive model is generated through execution of a machine learning algorithm with regard to the historic transaction data; and the fraud predictive model is periodically updated based on transaction data of transactions that occur subsequent to a last generation of the fraud predictive model.

11. The method of claim 10, wherein the transaction data processed by the machine learning algorithm includes data representative of scanning behaviors of items scanned and added to the self-scan dataset and subsequently removed prior to submission of the self-scan dataset within the purchase data processing transaction.

12. The method of claim 9, wherein evaluating the self-scan dataset to determine whether to require a rescan of items represented in the self-scan dataset further includes applying one or more configurable rules.

13. The method of claim 12, wherein the one or more configurable rules include at least one of:

a transaction trigger that identifies a data condition with regard to one or more data items that trigger a rescan requirement when present within a self-scan dataset;

periodic and random rescan requirements with regard to all transactions;

periodic and random rescan requirements with regard to a known customer;

periodic and random rescan requirements with regard to an unknown customer; and a data input by an employee requiring a rescan.

14. The method of claim 13, wherein periodic and random rescan requirements of known customers are influenced by a determined trust level of respective customers that are influenced at least in part by a history of prior transactions including at least one item identified through rescanning.

15. The method of claim 9, wherein the self-scan device is a store provided device.

16. A system comprising:

at least one processor;

a network interface device;

at least one memory device storing instructions executable by the at least one processor to perform data processing activities comprising:

receiving, via the network interface device from a self-scanning device, a self-scan dataset of items for purchase within a purchase data processing transaction;

evaluating the self-scan dataset to determine whether to require a rescan of items represented in the self-scan dataset by classifying the self-scan dataset based at least upon a transaction classification model generated by a machine learning algorithm processing of completed transaction data that included data of transactions with un-scanned items that were identified through rescanning;

when a rescan is determined to be required, transmitting via the network interface device to at least one of the self-scan device and at least one device of a device of a store employee data indicating a rescan is required; and when a rescan is not determined to be required, permitting the purchase data processing transaction to proceed.

17. The system of claim 16, wherein permitting the purchase transaction to proceed includes transmitting data via network interface device to at least the self-scanning device.

* * * * *